US008823613B2

(12) United States Patent
Chung et al.

(10) Patent No.: US 8,823,613 B2
(45) Date of Patent: Sep. 2, 2014

(54) PIXEL CIRCUIT INCLUDING INITIALIZATION CIRCUIT AND ORGANIC ELECTROLUMINESCENT DISPLAY INCLUDING THE SAME

(75) Inventors: Bo-Yong Chung, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 492 days.

(21) Appl. No.: 12/831,923

(22) Filed: Jul. 7, 2010

(65) Prior Publication Data

US 2011/0074757 A1 Mar. 31, 2011

(30) Foreign Application Priority Data

Sep. 30, 2009 (KR) ..... 10-2009-0093209

(51) Int. Cl.
*G09G 3/30* (2006.01)

(52) U.S. Cl.
USPC ..... 345/77; 345/82

(58) Field of Classification Search
USPC ..... 345/76–83; 315/169.3
See application file for complete search history.

(56) References Cited

U.S. PATENT DOCUMENTS

2004/0217925 A1* 11/2004 Chung et al. ..... 345/76
2006/0077138 A1* 4/2006 Kim ..... 345/76
2006/0082524 A1* 4/2006 Kwon ..... 345/76
2006/0107146 A1 5/2006 Kim et al.
2006/0238461 A1* 10/2006 Goh et al. ..... 345/76
2006/0244688 A1* 11/2006 Ahn et al. ..... 345/76
2008/0224965 A1* 9/2008 Kim ..... 345/76

FOREIGN PATENT DOCUMENTS

KR 10-2003-0060461 7/2003
KR 10-2004-0072215 8/2004
KR 10-2005-0049686 A 5/2005
KR 10-2006-0018766 A 3/2006
KR 10-2006-0113000 A 11/2006
KR 10-2008-0022718 3/2008
KR 10-2008-0080755 A 9/2008

OTHER PUBLICATIONS

Registration Determination Certificate issued by KIPO for KR 10-2009-0093209 (5 pages).

* cited by examiner

*Primary Examiner* — Chanh Nguyen
*Assistant Examiner* — Sanghyuk Park
(74) *Attorney, Agent, or Firm* — Christie, Parker & Hale, LLP

(57) ABSTRACT

A pixel circuit for an organic light emitting display includes: a fourth NMOS transistor including a gate electrode coupled to a first scan line, and a first electrode coupled to a first node; a storage capacitor coupled between the first node and a second node; a third NMOS transistor including a gate electrode coupled to a second scan line, and a first electrode coupled to a data line; a second NMOS transistor including a first electrode coupled to a second electrode of the third NMOS transistor, and a gate electrode and a second electrode coupled to the first node; a fifth NMOS transistor including a gate electrode coupled to an emission control line, and a first electrode coupled to a first power source; an organic light emitting diode (OLED) comprising an anode coupled to the second node; and a first NMOS transistor for providing a driving current to the OLED.

17 Claims, 4 Drawing Sheets

① INITIALIZATION PERIOD
② DATA WRITING AND VTH COMPENSATION PERIOD
③ EMISSION PERIOD

PIXEL CIRCUIT INCLUDING INITIALIZATION CIRCUIT AND ORGANIC ELECTROLUMINESCENT DISPLAY INCLUDING THE SAME

CROSS-REFERENCE TO RELATED APPLICATIONS

This application claims priority to and the benefit of Korean Patent Application No. 10-2009-0093209, filed on Sep. 30, 2009, in the Korean Intellectual Property Office, the disclosure of which is incorporated herein in its entirety by reference.

BACKGROUND

1. Field

One or more embodiments of the present invention relate to a pixel circuit and an organic electroluminescent display including the same.

2. Description of the Related Art

Flat panel displays such as liquid crystal displays (LCDs), plasma display panels (PDPs), field emission displays (FEDs), or organic light emitting displays have been developed to overcome disadvantages of cathode-ray tube (CRT) displays. Among these displays, organic light emitting displays are receiving more attention as a next-generation display due to their high luminescence efficiency, high brightness, wide viewing angles, and short response time.

Organic light emitting displays display images using organic light emitting diodes (OLEDs), which generate light via recombination of electrons and holes. Organic light emitting displays are driven with low power consumption while having a short response time.

SUMMARY

One or more embodiments of the present invention include a pixel circuit in which initialization and compensation are performed during different time periods and an organic electroluminescence display including the pixel circuit.

Additional aspects will be set forth in part in the description which follows and, in part, will be apparent from the description, or may be learned by practice of the presented embodiments.

According to one or more embodiments of the present invention, a pixel circuit includes: a fourth NMOS transistor including a gate electrode coupled to a first scan line and a first electrode coupled to a first node; a storage capacitor coupled between the first node and a second node; a third NMOS transistor including a gate electrode coupled to a second scan line and a first electrode coupled to a data line; a second NMOS transistor including a first electrode coupled to a second electrode of the third NMOS transistor and a gate electrode and a second electrode commonly coupled to the first node; a fifth NMOS transistor including a gate electrode coupled to an emission control line and a first electrode coupled to a first power source; an organic light emitting diode comprising an anode coupled to the second node; and a first NMOS transistor for providing a driving current to the organic light emitting diode, the first NMOS transistor including a gate electrode coupled to the first node, a first electrode coupled to a second electrode of the fifth NMOS transistor, and a second electrode coupled to the second node.

The fourth NMOS transistor may be configured to transfer an initialization voltage from an initialization power source to the first node when a first scan signal is transmitted through the first scan line.

The third NMOS transistor may be configured to transfer a data signal transmitted through the data line to the first electrode of the second NMOS transistor when a second scan signal is transmitted through the second scan line.

The pixel circuit may further include a sixth NMOS transistor including a gate electrode coupled to the second scan line, a first electrode coupled to a reference power source, and a second electrode coupled to the second node.

The sixth NMOS transistor may be configured to transfer a reference voltage from the reference power source to the second node when a second scan signal is transmitted through the second scan line, wherein the reference voltage is less than a threshold voltage of the organic light emitting diode.

The pixel circuit may further include a sixth NMOS transistor that has a gate electrode coupled to the second scan line, a first electrode coupled to the first scan line, and a second electrode coupled to the second node.

The sixth NMOS transistor may be configured to transfer a voltage at the first scan line through the first scan line to the second node when a second scan signal is transmitted through the second scan line, wherein the voltage at the first scan line is less than a threshold voltage of the organic light emitting diode.

The pixel circuit may further include a sixth NMOS transistor including a gate electrode coupled to the second scan line, a first electrode coupled to the emission control line, and a second electrode coupled to the second node.

The sixth NMOS transistor may be configured to transfer a voltage at the emission control line through the emission control line to the second node when a second scan signal is transmitted through the second scan line, wherein the voltage at the emission control line is less than a threshold voltage of the organic light emitting diode.

The first electrode of the first NMOS transistor is a drain electrode, and the second electrode of the first NMOS transistor is a source electrode.

The first NMOS transistor and the second NMOS transistor have substantially a same threshold voltage.

According to one or more embodiments of the present invention, an organic light emitting display includes: a scan driver for supplying scan signals to scan lines and emission control signals to emission control lines; a data driver for supplying data signals to data lines; and pixel circuits at crossing regions of the scan lines, the emission control lines, and the data lines, wherein at least one of the pixel circuits includes: a fourth NMOS transistor including a gate electrode coupled to a first scan line of the scan lines, and a first electrode coupled to a first node; a storage capacitor coupled between the first node and a second node; a third NMOS transistor including a gate electrode coupled to a second scan line of the scan lines, and a first electrode coupled to a data line of the data lines; a second NMOS transistor including a first electrode coupled to a second electrode of the third NMOS transistor, and a gate electrode and a second electrode commonly coupled to the first node; a fifth NMOS transistor including a gate electrode coupled to an emission control line of the emission control lines, and a first electrode coupled to a first power source; an organic light emitting diode including an anode coupled to the second node; and a first NMOS transistor for providing a driving current to the organic light emitting diode, the first NMOS transistor including a gate electrode coupled to the first node, a first electrode coupled to a second electrode of the fifth NMOS transistor, and a second electrode coupled to the second node.

In the at least one of the pixel circuits, the fourth NMOS transistor may be configured to transfer an initialization voltage from an initialization power source to the first node when a first scan signal from among the scan signals is transmitted through the first scan line, and the third NMOS transistor may be configured to transfer a data signal from among the data signals transmitted through the data line to the first electrode of the second NMOS transistor when a second scan signal from among the scan signals is transmitted through the second scan line.

The scan driver may be configured to sequentially supply the first scan signal and the second scan signal to each of the pixel circuits.

At least one of the pixel circuits may further include a sixth NMOS transistor that has a gate electrode coupled to the second scan line, a first electrode coupled to a reference power source, and a second electrode coupled to the second node, wherein the sixth NMOS transistor may be configured to transfer the reference voltage from the reference power source to the second node when a second scan signal from among the scan signals is transmitted through the second scan line.

The reference voltage from the reference power source may be less than a threshold voltage of the organic light emitting diode.

The at least one of the pixel circuits may further include a sixth NMOS transistor including a gate electrode coupled to the second scan line, a first electrode coupled to the first scan line, and a second electrode coupled to the second node, wherein the sixth NMOS transistor may be configured to transfer a voltage at the first scan line through the first scan line to the second node when a second scan signal from among the scan signals is transmitted through the second scan line.

The voltage at the first scan line may be less than a threshold voltage of the organic light emitting diode.

Each of the pixel circuits may further include a sixth NMOS transistor that has a gate electrode coupled to the second scan line, a first electrode coupled to the emission control line, and a second electrode coupled to the second node, wherein the sixth NMOS transistor may be configured to transfer a voltage at the emission control line through the emission control line to the second node when a second scan signal from among the scan signals is transmitted through the second scan line.

The voltage at the emission control line may be less than a threshold voltage of the organic light emitting diode.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
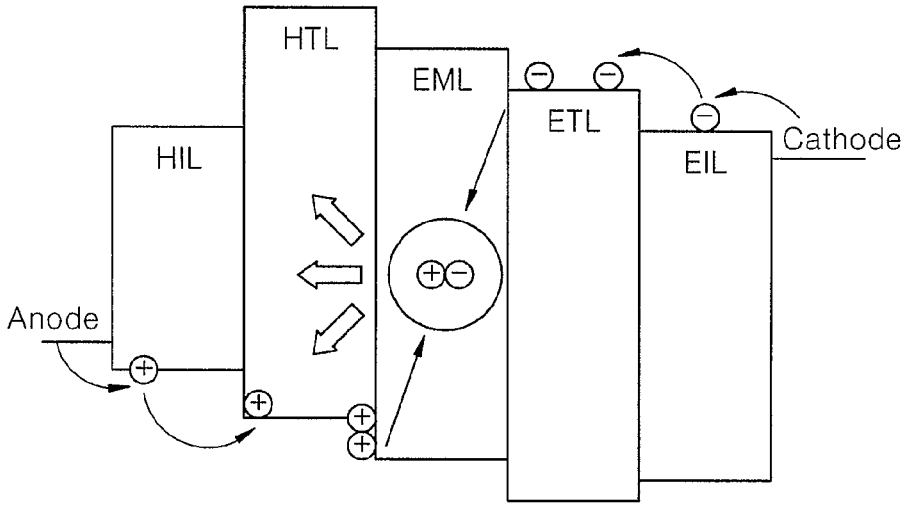
FIG. 1 is a schematic view of an organic light emitting diode according to one embodiment of the present invention.

Reference will now be made in detail to embodiments, examples of which are illustrated in the accompanying drawings, wherein like reference numerals refer to like elements throughout and description of the same or corresponding elements will not be repeatedly presented. In this regard, the present embodiments may have different forms and should not be construed as being limited to the descriptions of embodiments set forth herein. Accordingly, the embodiments are merely described below, by referring to the figures, to explain aspects of the present invention.

In general, an organic electroluminescent display (e.g., organic light emitting display) is a display device that emits light by electrically exciting a fluorescent organic compound and that produces an image by voltage-driving or current-driving a plurality of organic light emitting cells arranged in a matrix. Such organic light emitting cells are also referred to as organic light emitting diodes (OLEDs) due to their diode-like characteristics.

FIG. 1 is a schematic view of an OLED.

Referring to FIG. 1, the OLED includes an anode (composed of, e.g., indium tin oxide: ITO), an organic thin film, and a cathode (composed of, e.g., a metal). The organic thin film may include, in order to improve luminescence efficiency by maintaining a balance between electrons and holes, an emitting layer (EML), an electron transport layer (ETL), and a hole transport layer (HTL). The organic thin film may further include a hole injecting layer (HIL) and/or an electron injecting layer (EIL).

The organic light emitting cells (of an organic electroluminescent display) may be driven in a passive matrix manner, or in an active matrix manner using a thin film transistor (TFT) or a metal-oxide-semiconductor field-effect transistor (MOSFET). In an organic electroluminescent display driven in a passive matrix manner, the cathode is formed to be perpendicular to the anode and driving is performed by selecting a line. In an organic electroluminescent display driven according to an active matrix manner, a TFT is coupled to an ITO pixel electrode and driving is performed according to a voltage stored in a capacitor coupled to a gate of the TFT. Among various active matrix driving methods, there is a voltage driving method in which a voltage signal is applied to provide a voltage to a capacitor to sustain the voltage therein.

Figure 2:
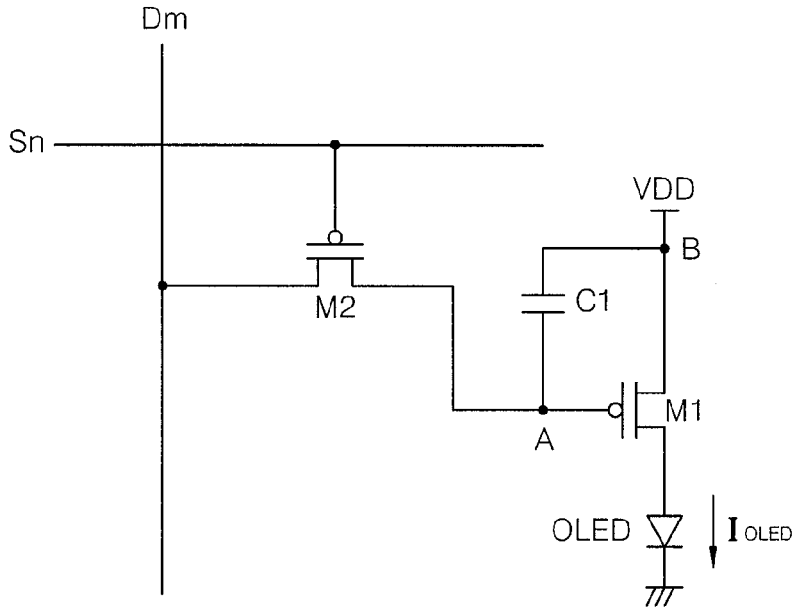
FIG. 2 is a circuit diagram of a pixel circuit driven according to a voltage driving method.

FIG. 2 is a circuit diagram of a pixel circuit driven according to a voltage driving method.

Referring to FIG. 2, a switching transistor M2 is turned on when a selection signal is transmitted through a selected scan line Sn. When the switching transistor M2 is turned on, a data signal transmitted through a data line Dm is transferred to a gate of a driving transistor M1, and a potential difference between the data voltage signal and a voltage source VDD is stored in a capacitor C1 coupled between the gate and a source of the driving transistor M1. Due to the potential difference, a driving current $I_{OLED}$ flows through an OLED and thus the OLED emits light. In this regard, a gray level display (e.g., a predetermined contrast gray level display) is enabled according to the level of the applied data voltage signal.

However, in a plurality of pixel circuits, individual driving transistors M1 may have different threshold voltages. If the driving transistors M1 of pixel circuits have different threshold voltages, the driving transistors M1 may output different amounts of current for a given data voltage signal and thus the image may not have uniform brightness. Such a threshold voltage variation of the driving transistors M1 may increase as the size of an organic electroluminescence display increases, and accordingly, image quality of the organic electroluminescence display may be degraded. Thus, to obtain a more uniform image from an organic electroluminescent display (or organic light emitting display), the threshold voltage of each of the driving transistors M1 of pixel circuits included in the organic electroluminescent light emitting display may be compensated for.

The threshold voltage of each of the driving transistors M1 of pixel circuits may be compensated for using various application circuits. However, most of these various application circuits concurrently (e.g., simultaneously) perform initialization and compensation for the threshold voltages of the driving transistors M1 for a predetermined amount of time. During initialization, unwanted emission may occur and contrast ratio (C/R) may be degraded. In addition, larger organic-electroluminescent displays (or organic light emitting displays) may require longer initialization times, but concurrently performing initialization and compensation for the threshold voltages of the driving transistors M1 may substantially reduce the initialization time compared to smaller organic-electroluminescent light emitting displays. However, the unwanted emission and contrast ratio degradation may be reduced or prevented by a pixel circuit that drives the initialization and the compensation at separate times.

Figure 3:
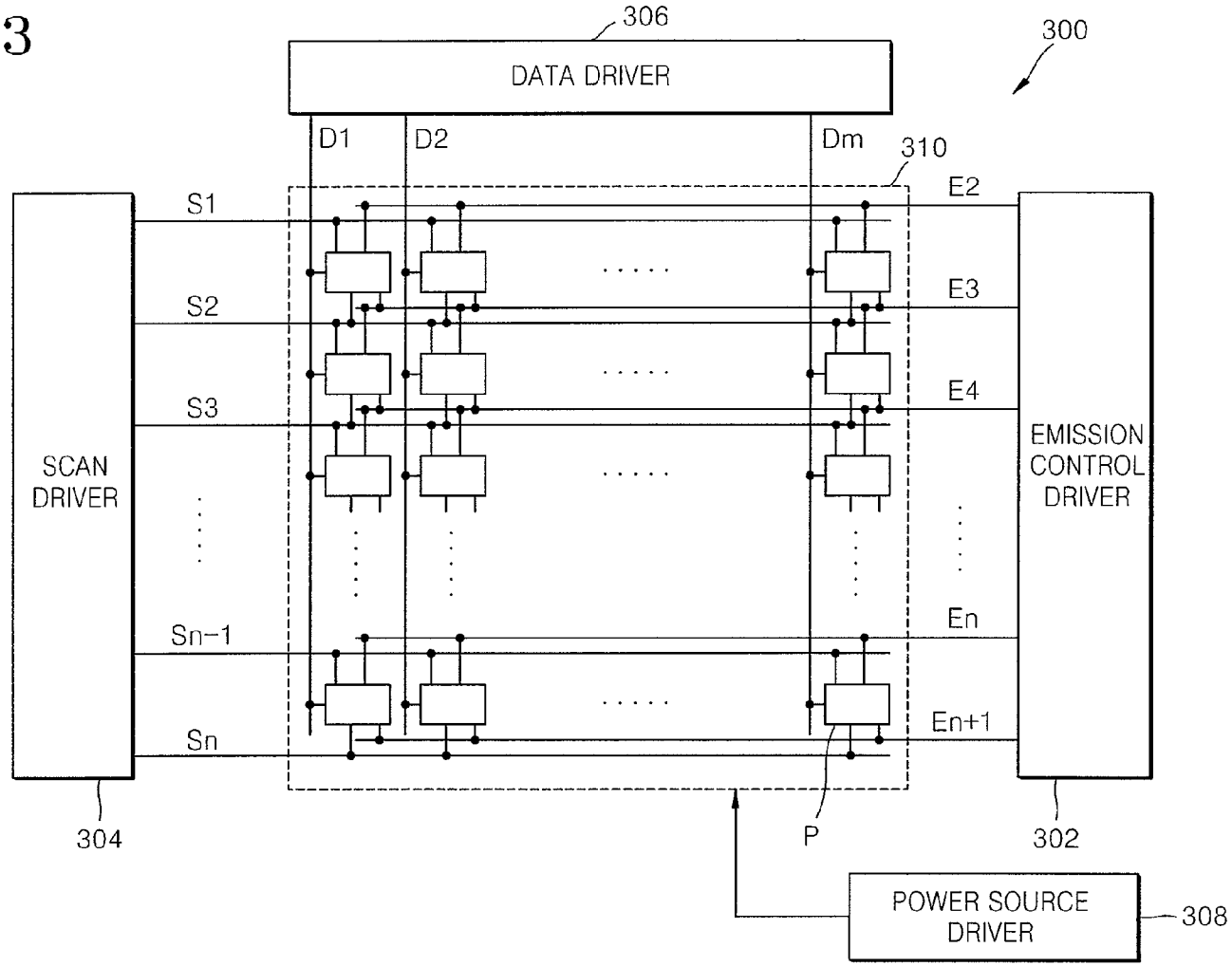
FIG. 3 is a block diagram of an organic electroluminescence display according to an embodiment of the present invention.

FIG. 3 is a block diagram of an organic electroluminescence display (e.g., organic light emitting display) 300 according to one embodiment of the present invention.

Referring to FIG. 3, the organic electroluminescence display 300 according to one embodiment includes a display unit 310, an emission control driver 302, a scan driver 304, a data driver 306, and a power source driver 308.

The display unit 310 may include n×m pixel circuits P each including an OLED (not shown), scan lines S1 through Sn that are aligned (e.g., extending) in rows and for transferring scan signals, data lines D1 through Dm that are aligned (e.g., extending) in columns and for transferring data signals, emission control lines E2 through En+1 that are aligned (e.g., extending) in rows and for transferring emission control signals, and m first power source lines (not shown) and m second power source lines (not shown) for transferring power applied to the pixels.

The display unit 310 may control the OLEDs (e.g., see FIG. 4) to emit light by using scan signals, data signals, emission control signals, and a first voltage from a first power source ELVDD and a second voltage from a second power source ELVSS, in order to display an image.

The emission control driver 302 is coupled to the emission control lines E2 through En+1 and may apply emission control signals to the display unit 310.

The scan driver 304 is coupled to the scan lines S1 through Sn and may apply scan signals to the display unit 310.

The data driver 306 is coupled to the data lines D1 through Dm and may apply data signals to the display unit 310. The data driver 306 may provide a data signal (or data signals) to the pixel circuits P during a programming period.

The power source driver 308 may apply the first voltage of the first power source ELVDD and the second voltage of the second power source ELVSS to each of the pixel circuits P.

Figure 4:
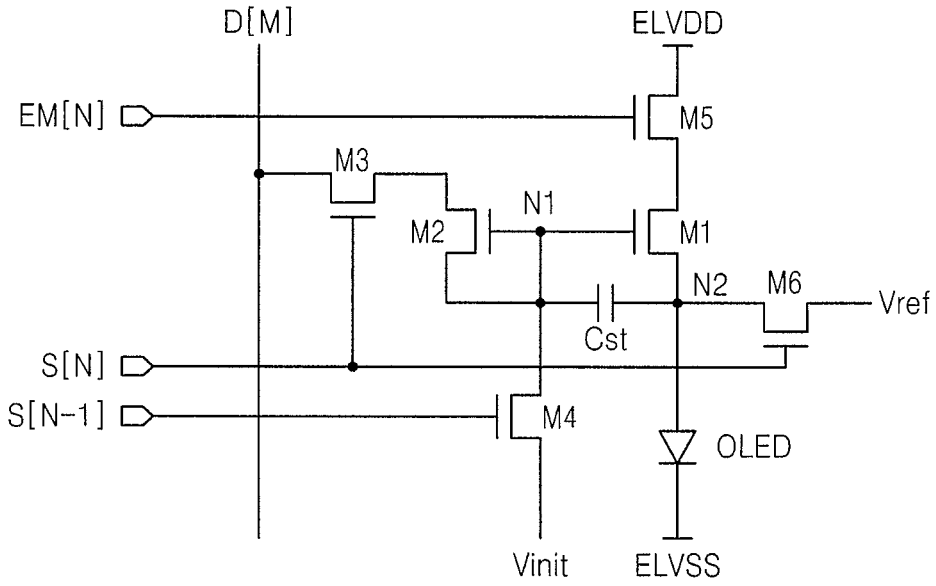
FIG. 4 is a circuit diagram of a pixel circuit illustrated in FIG. 3, according to an embodiment of the present invention.

FIG. 4 is a circuit diagram of a pixel circuit according to one embodiment of the present invention. For the sake of convenience, FIG. 4 illustrates a pixel circuit coupled to a first scan line S[N−1] (e.g., N−1th scan line), a second scan line S[N] (e.g., Nth scan line), an emission control line EM[N], and a data line D[M].

With regard to an OLED, an anode of the OLED is commonly coupled to a storage capacitor Cst, a source electrode of a first NMOS transistor M1, and a second node N2, and a cathode is coupled to the second power source ELVSS. According to the descriptions above, the OLED may generate light having a brightness (e.g., a predetermined brightness) corresponding to a current supplied by a driving transistor, which may be a first NMOS transistor M1. In addition, the anode is also coupled to a source electrode of a sixth NMOS transistor M6.

As illustrated in FIG. 4, the pixel circuit includes first through sixth NMOS transistors M1 through M6 and a storage capacitor Cst. In another embodiment of the present invention, the pixel circuit may not include the sixth NMOS transistor M6.

With respect to a fourth NMOS transistor M4, a gate electrode is coupled to the first scan line S[N−1] (e.g., the N−1th scan line), a first electrode is coupled to a first node N1, and a second electrode is coupled to an initialization power source Vinit. The fourth NMOS transistor M4 may be turned on when a first scan signal, that is, a high-level voltage signal, is provided through the first scan line S[N−1], and, when turned on, may transfer an initialization voltage from the initialization power source Vinit to the first node N1.

The storage capacitor Cst is coupled between the first node N1 and the second node N2. The storage capacitor Cst may store a voltage corresponding to a data signal Vdata from the data line D[M] and a voltage corresponding to a threshold voltage Vth_mr of a second NMOS transistor M2.

With respect to a third NMOS transistor M3, a gate electrode is coupled to the second scan line S[N] (e.g., Nth scan line) and a first electrode (e.g., drain electrode) is coupled to the data line D[M]. The third NMOS transistor M3 may be turned on when a second scan signal, that is, a high-level voltage signal, is provided through the second scan line S[N], and, when turned on, may transfer the data signal Vdata to a drain electrode of the second NMOS transistor M2.

With respect to the second NMOS transistor M2, the drain electrode is coupled to a source electrode of the third NMOS transistor M3, and a gate electrode and a source electrode are commonly coupled to the first node N1. The second NMOS transistor M2 may be a mirror transistor of the first NMOS transistor M1, and the first and second NMOS transistors M1 and M2 may have the same threshold voltage. The second NMOS transistor M2 may compensate for the threshold voltage of the first NMOS transistor M1.

With respect to a fifth NMOS transistor M5, a gate electrode is coupled to the emission control line EM[N], a drain electrode is coupled to the first power source ELVDD, and a source electrode is coupled to a drain electrode of the first NMOS transistor M1. The fifth NMOS transistor M5 may be turned on when an emission control signal is applied to the emission control line EM[N], that is, a high-level voltage signal, is provided through the emission control line EM[N], and, when turned on, may apply a first voltage from the first power source ELVDD to the drain electrode of the first NMOS transistor M1.

With respect to the first NMOS transistor M1, a gate electrode is coupled to the first node N1, the drain electrode is coupled to the source electrode of the fifth NMOS transistor M5, and the first electrode is coupled to the second node N2. Thus, the first NMOS transistor M1 may provide a driving current $I_{OLED}$ to the OLED. The driving current $I_{OLED}$ depends on a voltage difference Vgs between the gate electrode and the first electrode of the first NMOS transistor M1.

With respect to the sixth NMOS transistor M6, a gate electrode is coupled to the second scan line S[N], a drain electrode is coupled to a reference power source Vref, and the source electrode is coupled to the second node N2. The sixth NMOS transistor M6 may be turned on when the second scan signal, that is, a high-level voltage signal, is applied to the gate electrode thereof through the second scan line S[N], and, when turned on, may apply a reference voltage from the reference power source Vref to the second node N2. The sixth NMOS transistor M6 may supply a reference voltage which prevents or reduces a change in voltage at the second node N2, that is, at the source electrode of the first NMOS transistor M1, the change in voltage caused by characteristic scattering (or variation) and deterioration of the OLED. In addition, the sixth NMOS transistor M6 may provide a tolerance (or stability) in the event of a voltage drop of the cathode of the OLED, for example, a voltage drop that is generated by interconnection resistance. A voltage applied to the second node N2 when data is written, that is, the reference voltage from reference power source Vref, may be lower than a threshold voltage Vto of the OLED based on the second power source ELVSS (e.g., the voltage applied to the second node N2 may be less than ELVSS+Vto).

According to one embodiment of the present invention, in the pixel circuit, all the transistors M1 through M6 may be NMOS transistors, wherein the third through sixth NMOS transistors are switching transistors, a second NMOS transistor is a mirror transistor, and a first NMOS transistor is a driving transistor. An NMOS transistor refers to a N-type metal oxide semiconductor transistor, and when a control signal is in a low level (or low voltage) state, the NMOS transistor is turned off, and when the control signal is in a high level (or high voltage) state, the NMOS transistor is turned on. An NMOS transistor operates more quickly than a PMOS transistor and thus is useful in a large display.

A driving process of the pixel circuit described above with reference to FIG. 4 will be described in detail with reference to a timing diagram shown in FIG. 5.

Figure 5:
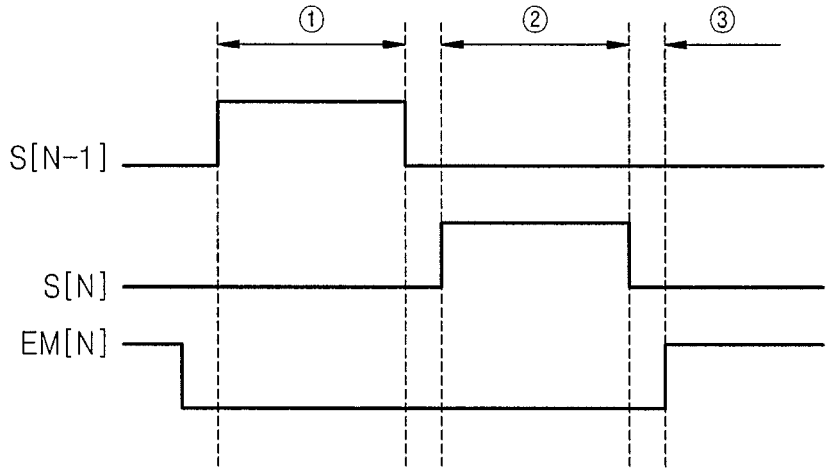
FIG. 5 is a timing diagram of driving signals (or waveforms) which may be used with the pixel circuit illustrated in FIG. 4 according to one embodiment of the present invention.

Referring to FIG. 5, a first period is an initialization period during which the first scan signal supplied through S[N−1] has a high level, a second period is a data writing and threshold voltage compensation period during which data is written to the storage capacitor Cst, during which, in order to compensate for the threshold voltage of the driving transistor, the second scan signal supplied through S[N] has a high level, and a third period is an emission period during which the emission control signal applied to the emission control line EM[N] has a high level. During the first and second periods, the emission control signal applied to the emission control line EM[N] has a low level.

With reference to FIGS. 4 and 5, switching and driving operations of transistors during the periods will be described in detail.

During the first period, when the first scan signal having a high level is applied through S[N−1], the fourth NMOS transistor M4 is turned on and thus the initialization voltage from the initialization power source Vinit is applied to the first node N1, thereby initializing the storage capacitor Cst and the gate electrodes of the first and second NMOS transistor M1 and M2.

During the second period, when the second scan signal having a high level is applied through S[N], the third NMOS transistor M3 is turned on and thus a data signal Vdata transmitted through the data line D[M] is applied to the drain electrode of the second NMOS transistor M2, wherein the gate electrode and source electrode of the second NMOS transistor M2 are commonly coupled to the first node N1, thereby diode-connecting the NMOS transistor M2. Thus, the threshold voltage Vth_mr of the second NMOS transistor N2 and the data signal Vdata are applied to the first node N1. In addition, the sixth NMOS transistor M6 is also turned on and thus, the reference voltage from the reference power source Vref is applied to the second node N2. Thus, the storage capacitor Cst is charged with a voltage corresponding to a voltage difference between the first node N1 and the second node N2.

During the third period, when an emission control signal having a high level is applied through EM[N], the fifth NMOS transistor M5 is turned on and thus, the first power source ELVDD is applied to the first NMOS transistor M1. The current $I_{OLED}$ flowing through the OLED is determined according to the following equation:

$$I_{OLED}=K(V_{gs}-V_{th})^2 \quad \text{Equation 1}$$

where K is a constant determined by mobility and parasitic capacitance of a driving transistor, Vgs is the voltage difference between gate and source electrodes of the driving transistor, and Vth is the threshold voltage of the driving transistor. In the present embodiment, Vgs is the voltage difference between the first node N1 and the second node N2, that is, the voltage difference between the gate electrode and source electrode of the first NMOS transistor M1. That is, the voltage of the gate electrode is Vdata+Vth_mr, and the voltage of the source electrode is Vref.

When Vgs is substituted for in Equation 1, Equation 2 is obtained as follows.

$$I_{OLED}=K(V_{data}+V_{th_mr}-V_{ref}-V_{th})^2 \quad \text{Equation 2}$$

In Equation 2, Vth and Vth_mr have substantially the same value. Thus, the (driving) current ($I_{OLED}$) is obtained as shown in Equation 3.

$$I_{OLED}=K(V_{data}-V_{ref})^2 \quad \text{Equation 3}$$

Referring to Equation 3, the current $I_{OLED}$ flowing through an OLED is determined by the reference voltage from the reference power source Vref and the data signal Vdata. That is, flow of the current $I_{OLED}$ is not related to the threshold voltage Vth of the first NMOS transistor M1, which is a driving transistor, nor is it related to the threshold voltage of the OLED or the voltage of the power from the second power source ELVSS coupled to the OLED.

Thus, since a pixel circuit according to an embodiment of the present invention compensates for the threshold voltage of a driving transistor and is not sensitive to scattering of (or variations in) first and second power sources, an image having improved uniformity of (e.g., substantially uniform) brightness may be obtained.

In addition, a pixel circuit according to one embodiment of the present invention is driven such that initialization is performed during a first period, and then compensation for the threshold voltage of a driving transistor is performed during a second period. Thus, incomplete initialization in some pixel circuits, which may occur due to an organic electroluminescence display being large and a large load caused by high-speed operation, is reduced or prevented. In addition, according to embodiments of the present invention, a current does not flow through an OLED during initialization because initialization is performed using an additional transistor, and thus the OLED does not emit light during initialization, and thus a high contrast ratio may be obtained. In addition, use of an emission control driver transmitting an emission control signal enables duty control which may remove or reduce motion blur and overcome cross-talk.

Figure 6:
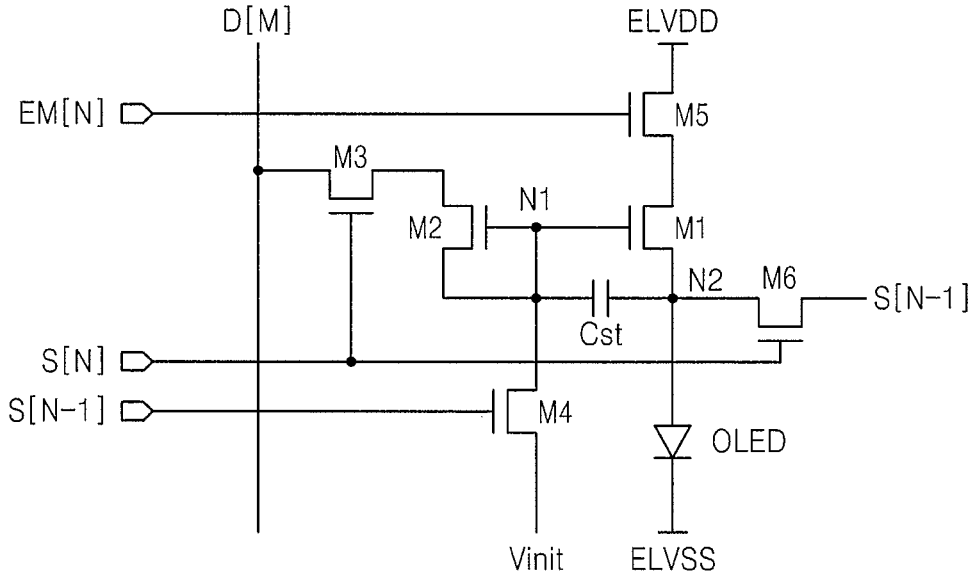
FIG. 6 is a circuit diagram of a pixel circuit illustrated in FIG. 3, according to another embodiment of the present invention.

FIG. 6 is a circuit diagram of a pixel circuit P illustrated in FIG. 3, according to another embodiment of the present invention.

Referring to FIG. 6, the pixel circuit according to one embodiment is different from the pixel circuit of FIG. 4 in that the drain electrode of the sixth NMOS transistor M6 is coupled to the first scan line S[N−1]. Thus, when the second scan signal having a high level is applied from the second scan line S[N], the sixth NMOS transistor M6 may be turned on and may transfer the first scan signal to the second node N2. The first scan signal may be a voltage (e.g., a predetermined voltage) that is lower than the threshold voltage of the OLED in reference to ELVSS. Thus, as described with reference to FIGS. 4 and 5, since a change in voltage of the source electrode of the NMOS transistor M1 (that is, a driving transistor) is reduced or prevented, the current supplied to the OLED is less influenced by factors such as characteristic scattering (or variation) and deterioration of an OLED and a voltage drop of the cathode.

Figure 7:
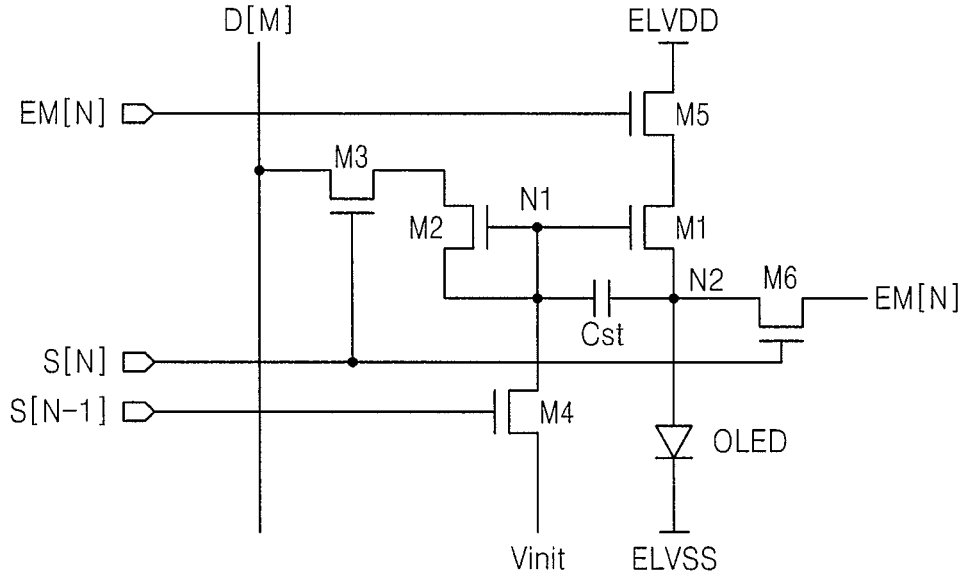
FIG. 7 is a circuit diagram of a pixel circuit illustrated in FIG. 3, according to another embodiment of the present invention.

FIG. 7 is a circuit diagram of a pixel circuit P illustrated in FIG. 3, according to another embodiment of the present invention.

Referring to FIG. 7, the pixel circuit according to this embodiment is different from the pixel circuit of FIG. 4 in that the drain electrode of the sixth NMOS transistor M6 is coupled to the emission control line EM[N]. Thus, when the second scan signal having a high signal is applied from the second scan line S[N], the sixth NMOS transistor M6 may be turned on and may transfer the emission control signal applied to the emission control line EM[N] to the second node N2. The emission control signal applied to the emission control line EM[N] may be a voltage (e.g., a predetermined voltage) that is lower than the threshold voltage of an OLED in reference to ELVSS.

Hereinbefore, various embodiments of the present invention have been described with reference to FIGS. 6 and 7. Driving methods and operations of various embodiments of the present invention that have been described with reference to FIGS. 6 and 7 are substantially the same as with respect to the embodiments of the present invention that have been described with reference to FIG. 1.

As described above, according to the one or more of the above embodiments of the present invention, initialization of a pixel circuit is separately performed from compensation and thus problems associated with large size organic electroluminescence displays are reduced or solved, contrast ratio (C/R) may be improved, cross-talk may be reduced or overcome, the threshold voltage of a driving transistor is compensated for, and the uniformity of the brightness of an image may be improved.

It should be understood that the exemplary embodiments described therein should be considered in a descriptive sense only and not for purposes of limitation. It is to be understood that the scope of the embodiments covers various modifications and equivalent arrangements included within the spirit and scope of the appended claims and their equivalents. Descriptions of features or aspects within each embodiment should typically be considered as available for other similar features or aspects in other embodiments.

What is claimed is:

1. A pixel circuit comprising:

a fourth NMOS transistor comprising a gate electrode coupled to a first scan line and a first electrode coupled to a first node;

a storage capacitor coupled between the first node and a second node;

a third NMOS transistor comprising a gate electrode coupled to a second scan line and a first electrode coupled to a data line;

a second NMOS transistor comprising a first electrode coupled to a second electrode of the third NMOS transistor and a gate electrode and a second electrode commonly coupled to the first node;

a fifth NMOS transistor comprising a gate electrode coupled to an emission control line and a first electrode coupled to a first power source;

an organic light emitting diode comprising an anode coupled to the second node;

a first NMOS transistor for providing a driving current to the organic light emitting diode, the first NMOS transistor comprising a gate electrode coupled to the first node, a first electrode coupled to a second electrode of the fifth NMOS transistor, and a second electrode coupled to the second node; and a sixth NMOS transistor comprising a gate electrode coupled to the second scan line, a first electrode coupled to a reference power source, and a second electrode coupled to the second node, wherein the sixth NMOS transistor is configured to transfer a reference voltage from the reference power source to the second node when a second scan signal is transmitted through the second scan line, wherein the reference voltage is less than a threshold voltage of the organic light emitting diode.

2. The pixel circuit of claim 1, wherein the fourth NMOS transistor is configured to transfer an initialization voltage from an initialization power source to the first node when a first scan signal is transmitted through the first scan line.

3. The pixel circuit of claim 1, wherein the third NMOS transistor is configured to transfer a data signal transmitted through the data line to the first electrode of the second NMOS transistor when a second scan signal is transmitted through the second scan line.

4. The pixel circuit of claim 1, further comprising a sixth NMOS transistor that has a gate electrode coupled to the second scan line, a first electrode coupled to the first scan line, and a second electrode coupled to the second node.

5. The pixel circuit of claim 4, wherein the sixth NMOS transistor is configured to transfer a voltage at the first scan line through the first scan line to the second node when a second scan signal is transmitted through the second scan line, wherein the voltage at the first scan line is less than a threshold voltage of the organic light emitting diode.

6. The pixel circuit of claim 1, further comprising a sixth NMOS transistor comprising a gate electrode coupled to the second scan line, a first electrode coupled to the emission control line, and a second electrode coupled to the second node.

7. The pixel circuit of claim 6, wherein the sixth NMOS transistor is configured to transfer a voltage at the emission control line through the emission control line to the second node when a second scan signal is transmitted through the second scan line, wherein the voltage at the emission control line is less than the threshold voltage of the organic light emitting diode.

8. The pixel circuit of claim 1, wherein the first electrode of the first NMOS transistor is a drain electrode and the second electrode of the first NMOS transistor is a source electrode.

9. The pixel circuit of claim 1, wherein the first NMOS transistor and the second NMOS transistor have substantially a same threshold voltage.

10. An organic light emitting display comprising:

a scan driver for supplying scan signals to scan lines and emission control signals to emission control lines;

a data driver for supplying data signals to data lines; and pixel circuits at crossing regions of the scan lines, the emission control lines, and the data lines, wherein at least one of the pixel circuits comprises:

a fourth NMOS transistor comprising a gate electrode coupled to a first scan line of the scan lines and a first electrode coupled to a first node;

a storage capacitor coupled between the first node and a second node;

a third NMOS transistor comprising a gate electrode coupled to a second scan line of the scan lines and a first electrode coupled to a data line of the data lines;

a second NMOS transistor comprising a first electrode coupled to a second electrode of the third NMOS transistor and a gate electrode and a second electrode commonly coupled to the first node;

a fifth NMOS transistor comprising a gate electrode coupled to an emission control line of the emission control lines and a first electrode coupled to a first power source;

an organic light emitting diode comprising an anode coupled to the second node;

a first NMOS transistor for providing a driving current to the organic light emitting diode, the first NMOS transistor comprising a gate electrode coupled to the first node, a first electrode coupled to a second electrode of the fifth NMOS transistor, and a second electrode coupled to the second node; and a sixth NMOS transistor that has a gate electrode coupled to the second scan line, a first electrode coupled to a reference power source, and a second electrode coupled to the second node, wherein the sixth NMOS transistor is configured to transfer a reference voltage from the reference power source to the second node when a second scan signal from among the scan signals is transmitted through the second scan line.

11. The organic light emitting display of claim 10, wherein, in the at least one of the pixel circuits, the fourth NMOS transistor is configured to transfer an initialization voltage from an initialization power source to the first node when a first scan signal from among the scan signals is transmitted through the first scan line, and the third NMOS transistor is configured to transfer a data signal from among the data signals transmitted through the data line to the first electrode of the second NMOS transistor when a second scan signal from among the scan signals is transmitted through the second scan line.

12. The organic light emitting display of claim 11, wherein the scan driver is configured to sequentially supply the first scan signal and the second scan signal to each of the pixel circuits.

13. The organic light emitting display of claim 10, wherein the reference voltage is less than a threshold voltage of the organic light emitting diode.

14. The organic light emitting display of claim 10, wherein the at least one of the pixel circuits further comprises a sixth NMOS transistor comprising a gate electrode coupled to the second scan line, a first electrode coupled to the first scan line, and a second electrode coupled to the second node, wherein the sixth NMOS transistor is configured to transfer a voltage at the first scan line through the first scan line to the second node when a second scan signal from among the scan signals is transmitted through the second scan line.

15. The organic light emitting display of claim 14, wherein the voltage at the first scan line is less than a threshold voltage of the organic light emitting diode.

16. The organic light emitting display of claim 10, wherein each of the pixel circuits further comprises a sixth NMOS transistor comprising a gate electrode coupled to the second scan line, a first electrode coupled to the emission control line, and a second electrode coupled to the second node, wherein the sixth NMOS transistor is configured to transfer a voltage at the emission control line through the emission control line to the second node when a second scan signal from among the scan signals is transmitted through the second scan line.

17. The organic light emitting display of claim 16, wherein the voltage at the emission control line is less than a threshold voltage of the organic light emitting diode.

* * * * *